United States Patent [19]

Crosby

[11] 4,352,524

[45] Oct. 5, 1982

[54] IMPROVEMENT IN UPHOLSTERED FURNITURE

[75] Inventor: Lawton H. Crosby, Lake Bluss, Ill.

[73] Assignee: Morley Furniture Spring Corporation, Lake Bluff, Ill.

[21] Appl. No.: 108,994

[22] Filed: Jan. 2, 1980

[51] Int. Cl.[3] ..... A47C 31/02

[52] U.S. Cl. ..... 297/452; 5/471; 24/204; 297/218

[58] Field of Search ..... 297/218, 219, 452; 5/471; 24/204

[56] References Cited

U.S. PATENT DOCUMENTS

| | | | |
|---|---|---|---|
| 3,063,749 | 11/1962 | Struble et al. | 297/218 X |
| 3,308,490 | 3/1967 | Cacioppo | 5/471 |
| 3,695,690 | 10/1972 | Carson | 297/218 |
| 3,842,456 | 10/1974 | Bronstien, Jr. | 297/218 X |
| 4,169,303 | 10/1979 | Lemelson | 24/204 |
| 4,216,257 | 8/1980 | Schams et al. | 24/204 X |

*Primary Examiner*—William E. Lyddane

*Attorney, Agent, or Firm*—Richard G. Lione

[57] ABSTRACT

An improvement in a fastening assembly for upholstery material on the rail of a metal frame in furniture seats or the like. The frame rail includes an outer member and a member extending inwardly of it along one of its edges; i.e., a flange formed on the web of a channel, for example. A first flexible fastening element is secured to said flange and has a plurality of tiny loops formed in it. A second flexible fastening element is secured to the periphery of the upholstery material and has a plurality of tiny gripping fingers formed in it. The fingers are pressed perpendicularly into the loops, causing them to interlock. The upholstery material drawn tight around the frame exerts stress on its fastening elements substantially only in shear.

1 Claim, 5 Drawing Figures

FIG. 1
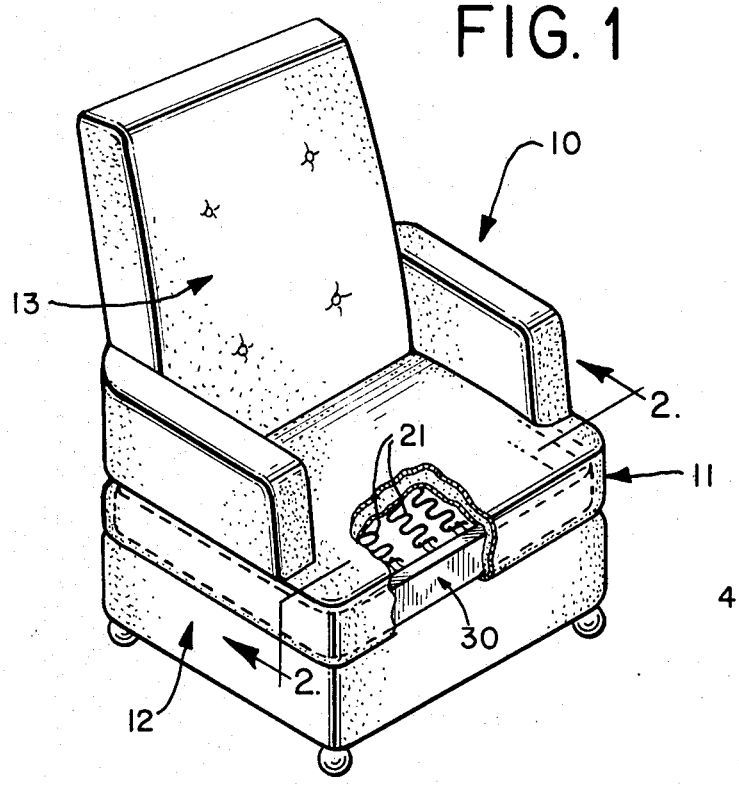
FIG. 3
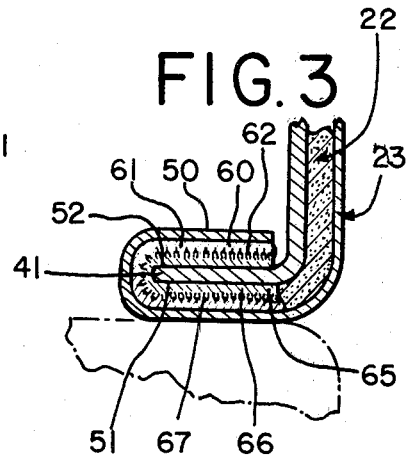
FIG. 2
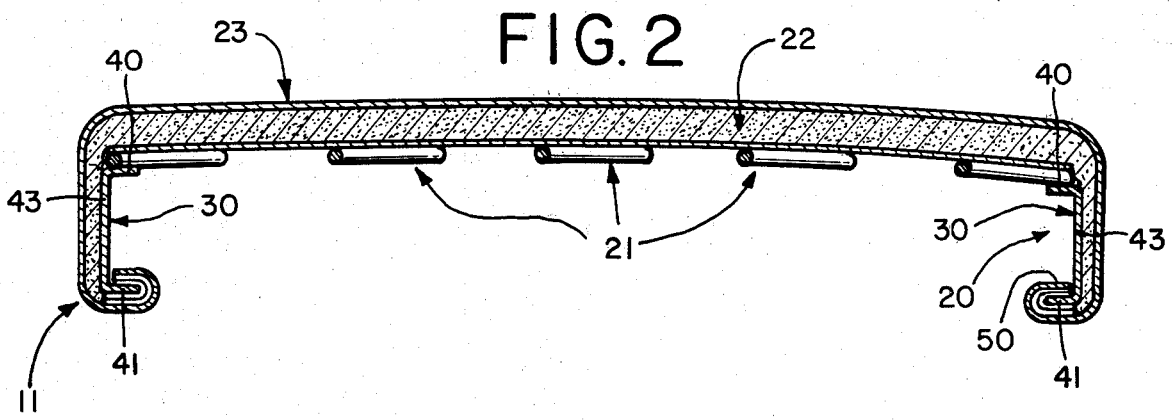
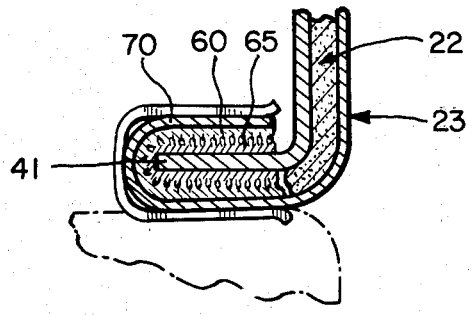
FIG. 4
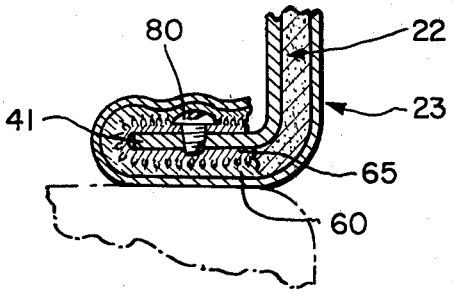
FIG. 5

IMPROVEMENT IN UPHOLSTERED FURNITURE

FIELD OF THE INVENTION

This invention relates to upholstered furniture. It relates particularly to upholstered furniture which employs a steel frame construction.

BACKGROUND OF THE INVENTION

Steel frame furniture presents some unique problems in upholstering. The upholstery material has to be fastened to the frame somehow. Conventional stapling techniques long used with wood frames cannot be applied directly to steel frames.

Various approaches have been employed for fastening upholstery material to steel frames. For example, the material has been fastened with rivet like elements sealed in preformed frame apertures. In a compromise, wood strips have been fastened with rivets and material then stapled to the wood strips.

All the steel frame upholstery methods heretofore employed have had one thing in common. They are labor intensive, time consuming, and relatively expensive.

SUMMARY OF THE INVENTION

An object of the present invention is to provide an improvement in upholstered, steel frame furniture or the like. Another object is to provide such an improvement wherein upholstery material is secured to the steel frame members in a new and highly improved manner. A further object is to provide a simple, inexpensive, yet completely effective mating of upholstery fabric and the rail members in a steel furniture frame or the like.

The foregoing and other objects are realized in accord with the present invention by providing flexible elements which are prefastened to the frame members and the periphery of the upholstery material. The fastening is accomplished by conventional sewing to the upholstery material and by one or more of several techniques, including adhesives, to the frame members. One flexible element has thousands of tiny plastic or fabric loops formed in mat-like fashion on its outer surface. The other flexible element has thousands of tiny plastic fingers with enlarged tips formed in the same way of its outer surface.

The upholstery fabric with one of the flexible elements sewn to its periphery is stretched in the plane of the material over the stuffing material. At its periphery the flexible element on the upholstery fabric is then pressed perpendicular to that plane against the corresponding flexible element on a steel frame member whereby the tiny finger tips and loops interlock and upholstering is completed.

The continuing stress to which the mated flexible members are subjected is effective substantially parallel to the planes of their surfaces. Similarly, the load on the fastening means between steel frame and flexible strip is substantially parallel to the planes of these surfaces. It is in these planes that the loop to finger tip mating is most resistant to disassembly. In fact, it has been found to be virtually impossible to pull them apart without tools.

BRIEF DESCRIPTION OF THE DRAWING

The invention, including its construction and method of operation, with additional objects and advantages thereof, is illustrated more or less diagrammatically in the drawing, in which:

FIG. 1 is a perspective view of an upholstered chair having a steel frame and employing the improvement in upholstery and frame assembly embodying features of the present invention;

FIG. 2 is a sectional view taken along line 2—2 of FIG. 1, with parts removed;

FIG. 3 is an enlarged view of a portion of FIG. 2 and illustrating the improved construction;

FIG. 4 is a view similar to FIG. 3 illustrating a second embodiment of the improved construction; and FIG. 5 is a view similar to FIG. 4 illustrating a third embodiment of the improved construction.

DESCRIPTION OF THE PREFERRED EMBODIMENTS

Referring now to the drawing, and particularly to FIG. 1, an upholstered chair is illustrated generally at 10. The chair 10 includes a seat base 11, a one piece "leg" assembly 12, and a back 13. The description of the invention is confined to the seat base 11 although it will be evident to those skilled in the art that the invention has application in furniture backs, arms, and all other upholstered elements as well.

Referring now also to FIG. 2 the seat base 11 comprises a seat frame 20 having a plurality of sinuous spring band assemblies 21 mounted herein. The frame 20 and the spring band assemblies 21, collectively, form a "deck" over which stuffing material 22 is laid and upholstery material 23 is stretched.

The frame 20 is fabricated of steel side rails 30, a front rail and a back rail. The rails in the illustrated frame 20 are each formed of a steel channel member fabricated in a conventional manner from heavy gauge strip stock having upper and lower horizontal flanges 40 and 41, respectively, facing inwardly of the frame 20, and a vertical web 43 forming the outer periphery of the frame.

The upholstery material 23 is fastened to the rails according to the present invention. Referring also to FIG. 3, the first embodiment of the improved steel rail and upholstery fabric assembly is illustrated in the context of a side rail 30.

The inner edge 50 of the upholstery material 23 is pulled downwardly over the web 43 of the rail 30, under lower surface 51 of the lower flange 41, and folded back outwardly over the upper surface 52 of the lower flange. According to the invention the material edge 50 has a flexible fastening element 60 of a character hereinafter described sewed to it along its entire length.

The flexible element 60 comprises a molded plastic sheet 61 in which thousands of upstanding tiny fingers 62 having enlarged tips on their free ends are integrally formed. The fingers 62 extend inwardly toward a corresponding flexible element 65 which is fastened to the flange 41.

The flexible element 65 is a strip which extends along the length of the flange 41. It includes a molded plastic or fabric sheet 66 in which thousands of upstanding tiny loops 67 are integrally formed. The loops form, in effect, a pile on the plastic or fabric sheet 66.

The sheet 66 is folded over the flange 41 so that it snugly engages the lower surface 51 and upper surface 52 of the flange. In the first embodiment of the invention the sheet 66 is fastened to the flange with a contact adhesive applied to both the non-loop side of the sheet and the upper and lower flange surfaces 52 and 51. The adhesive may be any conventional, high shear strength, extended life contact adhesive product.

With the flexible element 65 fixed in place, the upholstery material edge is pulled over the stuffing 22 and its edge 50 mounted flexible element 60 folded over the member 65. The elements 65 and 60 are pressed together perpendicular to their corresponding planes. The fingers 62 and loops 67 interlock, fastening the edge 50 of the upholstery material 23 to the lower flange 41 and thus the rail 30.

The connection or fastening between the upholstery material 23 and the rail 30 is of course, subjected to substantial stress during use of chair 10. The stress is exerted in shear along the planes of the flexible elements 60 and 65, however. It is in shear that the connection between these elements is strongest. Furthermore, it is in shear that the contact adhesive is strongest. In addition, the bend of the flexible elements 60 and 65 around the inner edge of the flange 41 creates a capstan effect, increasing by a substantial factor the resistance in shear to separation of either flexible element 60 from flexible element 65 or flexible element 65 from the flange surfaces 51, 52. The result is virtually a "lifetime" connection.

Turning now to FIG. 4, a second embodiment of the improved steel frame-upholstery material fastening construction is illustrated. This embodiment of the invention is identical to the first embodiment previously described with but one exception, a series of press fit fastening clips 70 are added to further enhance the holding force of the upholstery materials edge 50 to the rail flange 41. All other reference numerals identify components previously described.

The clips 70 are U-shaped spring clips which are forced over the flange 41 after the upholstery material edge 50 has been fastened to it in a manner previously discussed. The legs 71 of the clips 70 are forced apart to allow the flange 41 material edge 50 and flexible elements 60 and 65 to enter the clip. The legs 71 are released and tightly grip the material 23 to enhance the capstan effect.

Turning finally to FIG. 5 a third embodiment of the invention is shown. Here, instead of fastening clips 70, self-tapping metal screws 80 are employed to unequivocally fix the flexible element 65 to the flange 41. Otherwise the construction and operation of this embodiment is identical to that of the first described embodiment.

The flexible elements 60 and 65 have been described generally as to construction and operation. In practice they can be puchased ready-made, however. Examples of ready-made flexible elements 60 and 65 are the 3M Company's SCOTCHMATE dual lock products.

I claim:

1. In upholstered furniture having a metal frame over which upholstery material is stretched, the improvement in an upholstery material and metal frame rail fastening assembly, comprising:

(a) a metal frame rail including a strip member having upper and lower surfaces and a free edge, (b) a first flexible fastening element secured to said strip member and including a sheet having a plurality of tiny loops extending outwardly of said sheet to form a pile;

(c) said first flexible fastening element being folded over said free edge of said strip member and secured to both said upper and lower surfaces thereof;

(d) upholstery material having a second flexible fastening element secured thereto on one side of the material and adjacent one edge of the material;

(e) said second flexible fastening element including a sheet secured to said material and a plurality of tiny fingers with enlarged tips thereon extending outwardly of said second flexible element sheet;

(f) said upholstery material adjacent said one edge being folded over said first flexible fastening element and the fingers of second flexible element being pressed into the loops of said first flexible element whereby the cooperating elements serve to fasten the material to the rail and the stress exerted which tends to separate the elements is substantially only shear stress; and (g) U-shaped spring clip means which force said second flexible element against said first flexible element and said first flexible element against both said upper and lower surfaces.

* * * * *